US011051998B2

(12) United States Patent
Powell

(10) Patent No.: US 11,051,998 B2
(45) Date of Patent: Jul. 6, 2021

(54) PORTABLE AND COLLAPSIBLE SUPPORT STRUCTURES AND RELATED METHODS

(71) Applicant: The United States of America, as represented by the Secretary of the Navy, Crane, IN (US)

(72) Inventor: Timothy E. Powell, Temecula, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/823,690

(22) Filed: Mar. 19, 2020

(65) Prior Publication Data

US 2020/0352802 A1 Nov. 12, 2020

Related U.S. Application Data

(62) Division of application No. 15/386,510, filed on Dec. 21, 2016, now Pat. No. 10,632,030.

(60) Provisional application No. 62/369,965, filed on Aug. 2, 2016, provisional application No. 62/270,284, filed on Dec. 21, 2015.

(51) Int. Cl.

| | |
|---|---|
| ***A61G 1/013*** | (2006.01) |
| ***A61G 1/003*** | (2006.01) |
| ***A61G 7/10*** | (2006.01) |
| ***E01D 15/133*** | (2006.01) |
| ***A61G 1/04*** | (2006.01) |
| ***A61G 1/007*** | (2006.01) |
| ***A61G 1/02*** | (2006.01) |

(52) U.S. Cl.
CPC ..... *A61G 1/013* (2013.01); *A61G 1/003* (2013.01); *A61G 1/04* (2013.01); *A61G 7/103* (2013.01); *E01D 15/133* (2013.01); *A61G 1/007* (2013.01); *A61G 1/02* (2013.01)

(58) Field of Classification Search
CPC ..... A61G 1/003; A61G 1/007; A61G 1/013; A61G 1/02; A61G 1/04; A61G 7/103; E01D 15/133
See application file for complete search history.

(56) References Cited

U.S. PATENT DOCUMENTS 2,489,828 A * 11/1949 Springer ..... A61G 1/01 5/628
2,974,971 A * 3/1961 Buck ..... A01G 20/30 280/19
3,426,367 A * 2/1969 Bradford ..... A47C 17/705 5/626

(Continued)

OTHER PUBLICATIONS

Wikipedia, I-Beam.
Hetzer, Christopher, "How to Pick Dovetail Slides for Durable Designs," posted Mar. 6, 2015.

*Primary Examiner* — David R Hare
(74) *Attorney, Agent, or Firm* — Naval Surface Warfare Center, Crane Division; Christopher A. Monsey

(57) ABSTRACT

A reconfigurable portable load bearing structure which can be configured into an extended load bearing configuration or a collapsed configuration, comprising of a first, second and third plurality of rail segments that are each rotatably coupled together and a plurality of support segments or pads which are configured to selectively couple and latch into one of a plurality of positions on said first, second and third plurality of rail segments.

2 Claims, 11 Drawing Sheets

(56) References Cited

U.S. PATENT DOCUMENTS

| | | | | |
|---|---|---|---|---|
| 4,018,488 | A | 4/1977 | Manson | |
| 4,244,546 | A | 1/1981 | Mertes et al. | |
| 4,922,562 | A * | 5/1990 | Allred | A61G 1/013 128/870 |
| 5,058,575 | A * | 10/1991 | Anderson | A61F 5/05883 602/18 |
| 5,560,572 | A | 10/1996 | Osborn et al. | |
| 5,577,281 | A * | 11/1996 | Mital | A61G 7/103 5/625 |
| 6,216,296 | B1 * | 4/2001 | Carrasco | A61G 1/013 2/108 |
| 6,276,698 | B1 * | 8/2001 | Calandra | B62B 15/00 280/18 |
| 7,021,730 | B2 | 4/2006 | Remmers | |
| 7,810,190 | B1 * | 10/2010 | Antonio | A61G 1/013 5/627 |
| 9,220,647 | B1 * | 12/2015 | Steinbock | A61G 1/013 |
| 2009/0159767 | A1 | 6/2009 | Ko | |
| 2010/0138999 | A1 * | 6/2010 | Westmoreland, II | A61G 1/013 5/627 |
| 2010/0203780 | A1 * | 8/2010 | Hobbs | A61G 1/013 441/80 |
| 2015/0202099 | A1 * | 7/2015 | Sion | A61G 1/0293 5/627 |
| 2016/0158076 | A1 * | 6/2016 | Hobbs | A61G 7/1051 5/627 |

* cited by examiner

PORTABLE AND COLLAPSIBLE SUPPORT STRUCTURES AND RELATED METHODS

CROSS-REFERENCE TO RELATED APPLICATIONS

The present divisional application claims benefit to U.S. Non Provisional patent application Ser. No. 15/386,510, filed Dec. 21, 2016, entitled "PORTABLE AND COLLAPSIBLE SUPPORT STRUCTURES AND RELATED METHODS," which claims benefit of U.S. Provisional Patent Application Ser. No. 62/369,965, filed Aug. 2, 2016 entitled "PORTABLE AND COLLAPSIBLE LOAD BEARING STRUCTURES AND RELATED METHODS" which is related to U.S. Provisional Patent Application Ser. No. 62/270,284, filed Dec. 21, 2015 entitled "COLLAPSIBLE STRETCHER," the disclosures of which are expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,639) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

Various embodiments of the invention are directed to transportation structures that are configured to have a reduced footprint, volume, or size for transportation as well as providing a capacity for rapid assembly, secure carrying capacity for sensitive cargo, and high structural stability after assembly. In particular, embodiments of the invention include a collapsible stretcher designed to provide a lightweight, portable, medical evacuation device while allowing for a reduced footprint size for transportation. Some embodiments provide a rigid exoskeleton for an ambulatory patient that allows for immobilization of major body parts, and at the same time providing a rigid surface for emergency procedures to be performed on the trunk of the patient's body.

A stretcher is an apparatus used for moving patients who require medical care. A basic type (cot or litter) must be carried by two or more people. Whereas a wheeled stretcher (known as a gurney, trolley, bed or cart) is often equipped with variable height frames containing wheels, tracks, or skids. For example, emergency medical service (EMS) stretchers used in ambulances have wheels that make transportation over pavement easier, and have a lock inside the ambulance and seatbelts to secure the patient during transport. An integral lug on the gurney locks into a sprung latch within the ambulance in order to prevent movement during transport. These stretchers have the limitation of portability and weight. They require two individuals to move them and a hard surface for the use of rollers.

Simple stretchers can be made of canvas or other synthetic material suspended between two poles or tubular aluminum frame. These types of stretchers require two individuals to transport the patient and lack the rigid support for medical procedures to be performed upon an individual while attached to this device. They are also difficult to store and to transport.

A folding stretcher can be constructed that is similar in design to the simple stretcher, but features one or more hinged points of articulation to allow the stretcher to be collapsed into a more compact form for easier handling or storage. However, this type of stretcher with an exterior foldable system does not provide support to the midline of the supine individual's body while being transported.

A scoop type stretcher can be made for lifting patients, for instance from the ground onto an ambulance stretcher or long board. The two ends of this type of stretcher can be detached from each other, splitting the stretcher into two longitudinal halves. To load a patient, one or both ends of this type of stretcher are detached, the halves placed under the patient from either side and fastened back together. With obese patients, the possibility exists of accidentally pinching the patient's back when closing the stretcher, so care must be made not to injure them when carrying out this procedure.

A flexible stretcher can be made supported longitudinally by wooden or plastic planks. For example, one example can be formed as a kind of tarpaulin with handles. This type can be primarily used to move a patient through confined spaces (e.g. a narrow hallway), or to lift obese patients. This type of stretcher requires multiple rescuers to support the individual and does not provide a rigid area of support which may be required for a variety of medically necessary reasons.

Another type can include a litter or rescue basket that can be designed to be used where there are obstacles to movement or other hazards: for example, in confined spaces, on slopes, in wooded terrain. This type of stretcher can be shaped to accommodate an adult in a face up position and it is used in search and rescue operations. A patient can be strapped into the basket, making safe evacuation possible. The litter has raised sides and can include a removable head/torso cover for patient protection. After the person is secured in the litter, the litter may be wheeled, carried by hand, mounted on an ATV, towed behind skis, snowmobile, or horse, lifted or lowered on high angle ropes, or hoisted by helicopter. This type of stretcher is rigid and non-collapsible which makes transportation of the stretcher with limited space or carrying capacity problematic.

According to an illustrative embodiment of the present disclosure, a collapsible stretcher can be designed to provide a lightweight, portable, medical evacuation device while allowing for a reduced footprint size for transportation. Some embodiments provide a rigid exoskeleton for the ambulatory patient that allows for immobilization of major body parts, and at the same time providing a rigid surface for emergency procedures to be performed on the trunk of the patient's body. Embodiments include variants which include segmented sections which couple with each other in a variety of ways such as via various types of hinges, slides, or couplers which allow for rapid reconfiguration from stowed to employment modes. Some types of embodiments enable subassemblies of the collapsible stretcher to remain coupled in a reconfigured stowed mode which increases speed of reconfiguration and aids in avoiding loss of parts. Some embodiments include structural elements which enable adjustment of various elements of the collapsible stretcher to align with body parts of a particular patient and increase speed of reconfiguration. Various design aspects also reduce structure and weight as well as overall size needed to provide medical evacuation capacity which enable use in a wider variety of conditions.

Generally, embodiments of the invention can include a reconfigurable portable load bearing structure comprising a first, second and third plurality of rail segments rotatably each coupled together with a hinge structure and locking element and configured in a selectively latched or lockable extended rail configuration or a collapsed configuration comprising folded rail segments. Also provided in some embodiments is a plurality of support segments which are configured to selectively couple and latch into one of a plurality of positions on the first, second and third plurality of rail segments when the rail segments are in the extended rail configuration.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
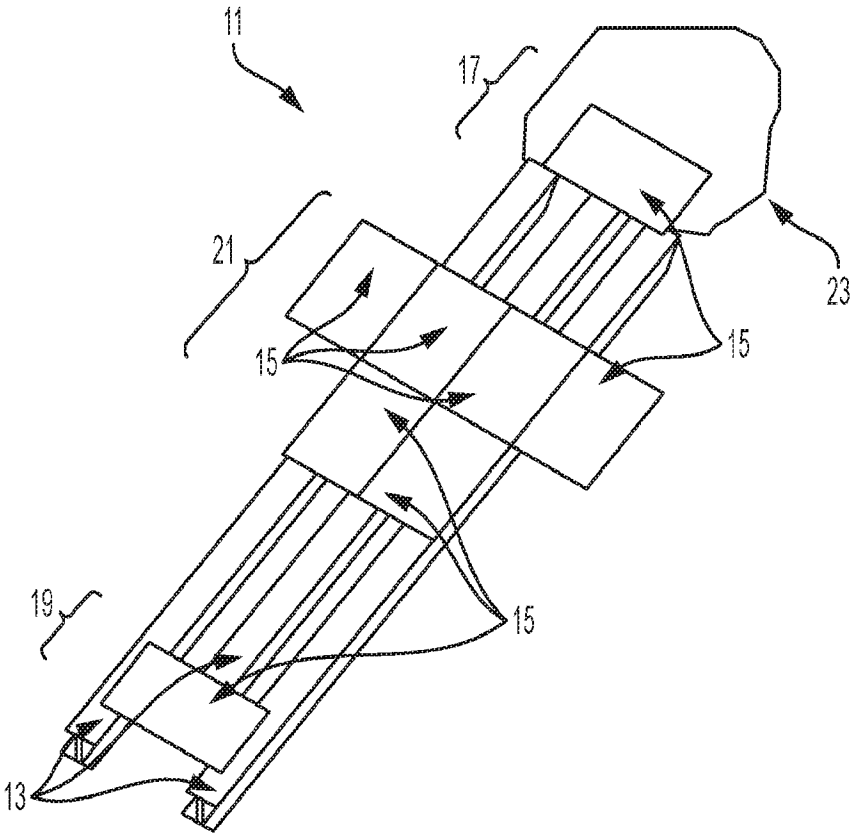
FIG. 1 shows a perspective view of an exemplary portable and collapsible load bearing structure such as a collapsible stretcher with collapsible rails and adjustable attachable support segments.

FIG. 1 shows a simplified perspective view of an embodiment of a collapsible exemplary stretcher 11 in an expanded or operational mode. The collapsible exemplary stretcher 11 comprises three collapsible rails 13 and a plurality of attachable and adjustable support segments 15. The adjustable support segments 15 are attached to the collapsible rails 13 in such a configuration that they construct a head support pad 17, a foot support pad 19, and a torso support pad 21. These support pads (17, 19, 21) are placed in such a configuration that they provide support to major body areas of a human shaped patient. The head support pad 17 provides support to a patient's head by attaching to one end of the collapsible rails 13, the foot support pad 19 provides support to a patient's feet or legs by attaching to an opposing end of the collapsible rails 13, and the torso support pad 19 provides support to a patient's torso region by attaching to the collapsible rails 13 between the head support pad 17 and the foot support pad 19. In this exemplary design, each of the adjustable support pads (17, 19, 21) are movable and can be adjusted to accommodate differing body shapes.

In some embodiments, the head support pad 17 can be constructed by a single support segment 15, the foot support pad 19 can also be constructed by a single support segment 15, and the torso support pad 21 can be constructed by six support segments 15 arranged into a first and second row, wherein the first row is constructed by four adjacent support segments 15, and the second support row includes two adjacent support segments 15. Collapsible rails 13 provide rigidity and support to the support segments 15 and an immovable structure to constrain the patient. In some embodiments, support segments 15 can slide onto collapsible rails 13 using low friction bearings and can be locked into place with quick lock fasteners or brakes. In some embodiments, support segments 15 can have rubber or foam materials secured to their upper surfaces to provide cushioning to the patient.

An attached pull cable 23 allows for single person movement of the patient via dragging an exemplary portable and collapsible load bearing structure (e.g. collapsible exemplary stretcher 11). An alternative embodiment design can include structures such as hand grips, to either be inserted, at four basic points for two-person carrying, or by allowing modification of the rails to accommodate hand holds. In some embodiments, helicopter hoisting can be accommodated by the use of snap rings at the head support pad 17 for vertical movement to an aircraft.

Straps (not shown) can be added to secure the patient to the stretcher which can be, for example, coupled to the collapsible rails 13 to wrap around the patient from one side to an opposing side. In some embodiments, holding straps can comprise nylon web material used at the patient's mass points to secure the patient to the stretcher. These exemplary straps could be made as part of the collapsible exemplary stretcher 11 or come as a separate pack with attachment points on the collapsible rails 13. Ratchets or buckles can be coupled to the straps that adjustably couple the straps together.

Although consideration was made for providing fragmentation protection, an overall increase in material cost will occur. In some embodiments, an exemplary design can include a ballistic wrap comprising of a Kevlar blanket and/or a thermal energy reflective blanket that can reduce ballistic hazards associated in transportation as well as providing a thermal protection feature while stabilizing the patient in cold weather.

Various embodiments of the invention can also provide for a compact and lightweight transportable device that allows for single operator transport and use. It allows the user to immobilize the patient upon the stretcher while providing critical support to major body parts. Use of light weight metals and aero plastics reduces the weight of various embodiments and increase ease of transportation and assembly.

Support segments 15 can be made of moldable rigid plastic. Some embodiments can have at least some of these segments connected or coupled together in a way that permits folding of the support segments 15. Embodiments of support segments 15 can possess thinner or hollow sections to allow for a lighter weight.

Additional features can include addition of wheels or skids (not shown) on one end of the collapsible exemplary stretcher 11 which permit the stretcher to be dragged by one person. These wheels or skids can be attached to ends of one or more collapsible rails 13. Such wheels can be inflatable wheels which can be inflated by a compressed gas cartridge which is applied to the wheels to inflate them via valve assembly disposed into the wheels.

Exemplary embodiments of the stretcher can include a harness coupling a patient to the stretcher which permits the stretcher to be dragged so as to support the patient at an angle and prevent the patient from falling off or sliding down the stretcher. One or more embodiments can include shock absorption structures which can be attached between the wheels and the stretcher which permit flexing and shock absorption as the stretcher is dragged. Such shock absorption structures can be flexible structures which permit flexing of the shock absorption structure. Additional protective structures can be included which provide a type of roll cage over the patient that can rotate up from stretcher to provide protection from the stretcher falling over such as two or more protective structures that can be coupled together.

In some embodiments, a collection of laterally disposed support segments 15 that create a torso support pad 21 can include six support segments 15 coupled together by hinges. The six support segments coupled together by hinges could then fold in such a way that they could stack on top of each other when the collapsible stretcher is in a folded or collapsed configuration. Embodiments of support segments 15 that form the trunk or torso support pad 21 can be hinged or coupled together with thinner or hollow sections to allow for easy assembly. In at least some embodiments, each support segment 15 can be formed as eight inches long by five inches wide and having a thickness of 1.2 inches.

Figure 2:
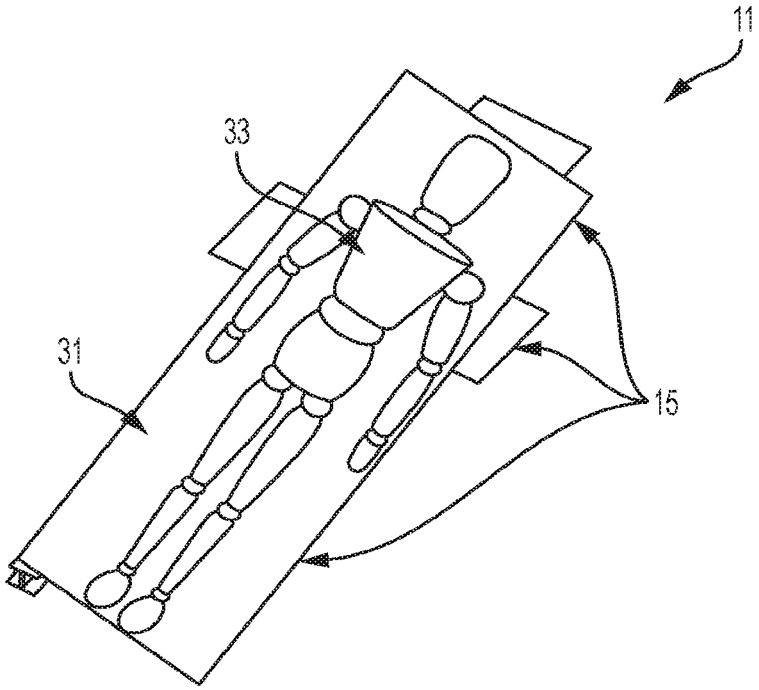
FIG. 2 shows an alternative embodiment of the FIG. 1 structure.

FIG. 2 shows a simplified FIG. 1 embodiment with the addition of an exemplary patient 33 and an upper or secondary supporting structure 31. In some embodiments, an upper or secondary supporting structure 31 can be another larger pad that fits over a larger region of the collapsible exemplary stretcher 11 than the head, foot, and torso support pads (17, 19, and 21). FIG. 2 shows an approximate position of the exemplary patient 33 on a collapsible exemplary stretcher 11 that is using an upper or secondary supporting structure 31 on top of it. Support segments 15 can be adjusted to provide optimum support.

Exemplary upper or secondary supporting structures 31 can be a larger pad or semi-flexible structure with or without additional structures such as a plurality of rigid members or segments which provide additional support or rigidity to the upper or secondary supporting structure 31. The upper or secondary supporting structure 31 can be inflatable, which can provide both support and increased rigidity. Additional stiffening structures can be included which slide into straps or passages in the upper or secondary supporting structure 31 which provide additional rigidity that is collapsible or expandable where the upper or secondary supporting structure 31 can be flexible, foldable, or roll-able in a stored configuration. A valve can be provided to permit inflation of an inflatable embodiment.

The upper or secondary supporting structure 31 can also include slides or coupling structures which attach to sections of the collapsible exemplary stretcher such as slides that engage with edges of the collapsible rails 13 or can be Velcro®, magnetic couplers, clips, buttons, or ties which attach the upper or secondary supporting structure to the collapsible exemplary stretcher assembly to keep the upper or secondary supporting structure 31 fixed with respect to the collapsible rails 13 and support segments 15.

Figure 3:
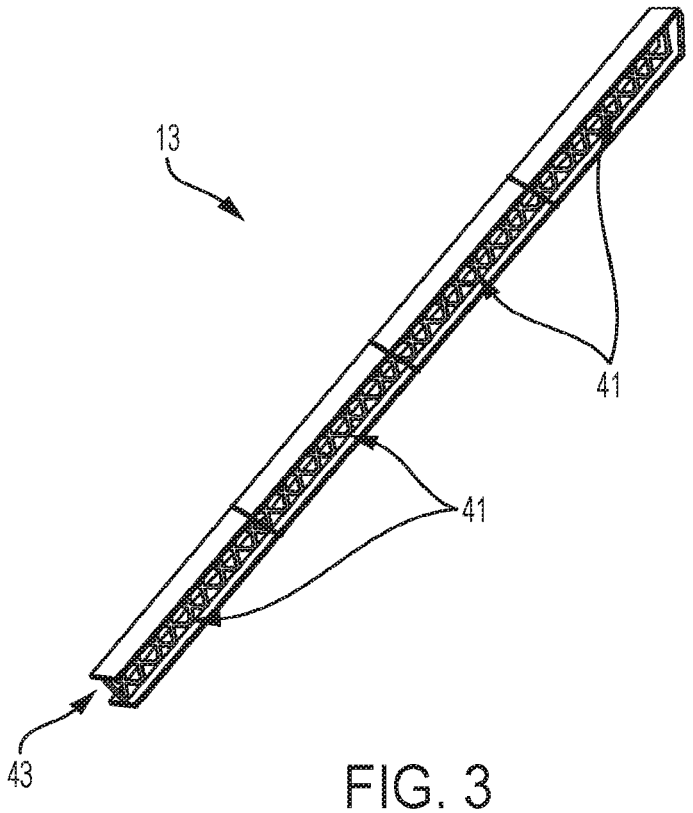
FIG. 3 shows an embodiment of exemplary collapsible rails in an extended configuration.

FIG. 3 shows an exemplary single collapsible rail 13 in an expanded or operational configuration without support segments 15 or other collapsible rails 13. In at least some embodiments, each collapsible rail 13 can be formed 2.5 inches high by 2.5 inches wide. An exemplary collapsible rail 13 can comprise four separate foldable rail segments 41, constructed of either plastic coated magnesium zinc alloy or aircraft aluminum. At least some exemplary collapsible rails 13 can have an I-beam structure 43 with interior web, cross-pieces, or cut-out structures for weight savings and structural strength where each folded segment can be designed to be stacked into a compact package. Some aspects of embodiments of the invention can include a spar based construction of the exemplary collapsible rails 13 to reduce excess weight.

Figure 4:
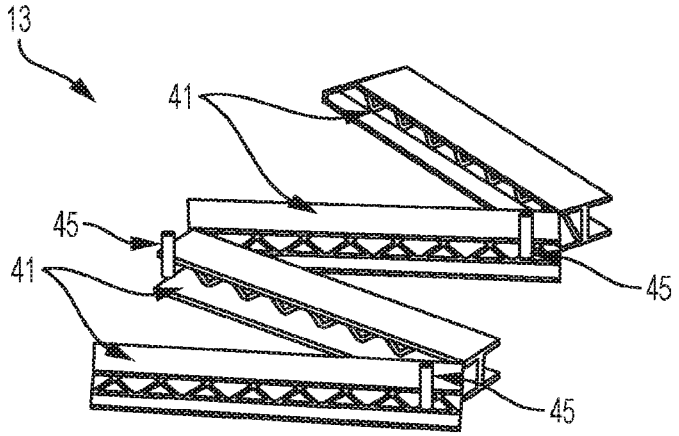
FIG. 4 shows the FIG. 3 rails in a partially folded configuration.

FIG. 4 shows the exemplary FIG. 3 collapsible rail 13 in a partially folded configuration. In this exemplary embodiment, hinges 45 can be used to foldably couple the rail segments 41. In some embodiments, these foldable rail segments 41 can also have locking structures which lock the foldable rail segments 41 together such as locking hinges or latches which couple ends of the foldable rail segments 41 together (e.g. overlapping latch structures which extend from one segment over another with a pivoting section and a pin that drops into a hole (not shown in this simplified drawing)) in an opposing segment section.

Figure 5:
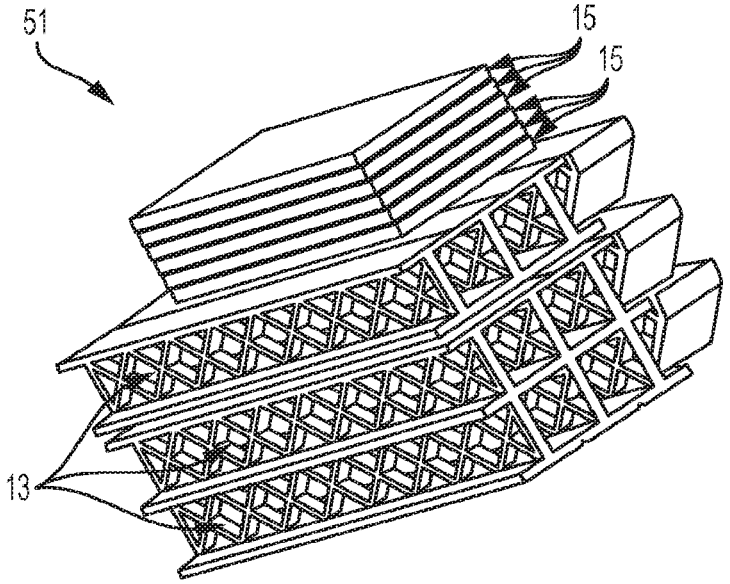
FIG. 5 shows a simplified diagram of the FIG. 1 embodiment with the rail segments folded and disposed side-by-side with exemplary support segments disposed on a surface of the rail segments.

FIG. 5 shows a perspective view of a collapsible exemplary stretcher 11 in an exemplary collapsed or folded configuration 51. The exemplary collapsed or folded configuration 51 includes a plurality of stacked support segments 15 disposed on top of a plurality of stacked collapsible rails 13 in a collapsed or folded configuration. In some embodiments, the collapsed or folded configuration 51 can be secured in place by straps or by locking pins that extend through the collapsible rails 13 and the support segments 15.

Figure 6:
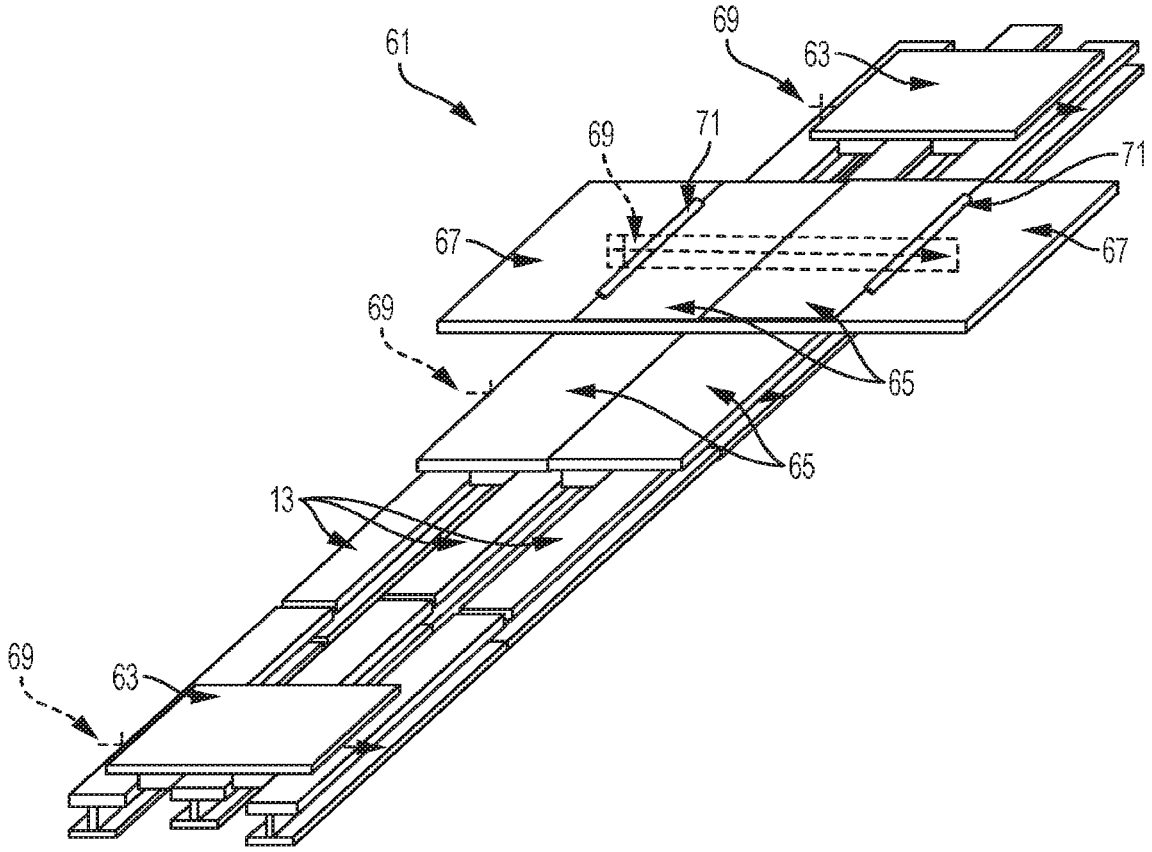
FIG. 6 shows a possible embodiment of a portable and collapsible load bearing structure.

FIG. 6 shows a possible alternate embodiment of the exemplary stretcher shown in FIG. 1. The embodiment shows a support structure 61 constructed by a plurality of collapsible rails 13, two head or foot support segments 63, four trunk or torso support segments 65, and two outer or shoulder support segments 67. The two head or foot support segment 63 are disposed onto opposing ends of the collapsible rails 13, the four trunk or torso support segments 65 are disposed in two rows onto the collapsible rails 13 between the two head or foot support segments 63, and the two outer or shoulder support segments 67 are disposed adjacently to the trunk or torso support segments 65 in such a way that they extend outward to provide support to the patient's shoulders.

In some embodiments, the head or foot support segments 63 and the trunk or torso support segments 65 can be secured in place onto apertures in the collapsible rails 13 by a plurality of locking bars 69 inserted into lateral holes or apertures through protrusions or guides extending from at least some of the support segments (not shown here; e.g., see FIG. 9, FIG. 18, etc.)). More locking bars 69 can be added to insert into protrusions or guides extending from lower sides of the segments that insert into gaps between at least two collapsible rails 13 (e.g., 63, 65, etc.) if additional strength and rigidity is required.

The outer support segments 67 can each be secured in place by coupling hinges 71 that couple to the edge of the outer support segment 67 to an adjacent trunk support segment 65. The coupling hinges 71 can be configured in such a way that the upper side of the outer support segments 67 will remain parallel with the upper side of the adjacent trunk or torso support segment 65 while the support structure 61 is in an extended or deployed configuration. An outer or shoulder support segment 67 can be coupled to an edge of one of the trunk or torso support segments 65 by coupling hinges 71 in such a way that the outer or shoulder support segment 67 can fold inward 180 degrees to stack on top of the trunk or torso support segment 65. In alternate embodiments, outer or shoulder support segments 67 could be coupled to the trunk or torso support segments 65 by extending the outer or shoulder support segment's 67 thickness and running a lengthened locking bar 69 through holes that horizontally pass through both the trunk or torso support segments 65 and the outer or shoulder support segments 67.

Figure 7:
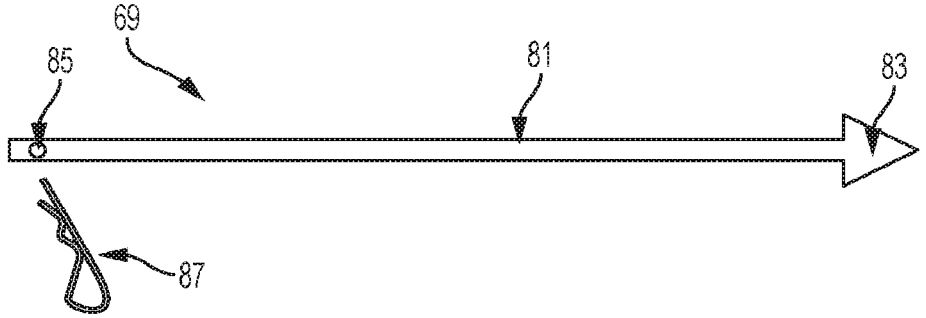
FIG. 7 shows a detailed view of the FIG. 6 locking bars.

FIG. 7 shows a detailed view of an exemplary single locking bar 69. Exemplary locking bar 69 is shown in a locked configuration includes an elongated body segment 81, a retainer segment (e.g., thicker segment) 83 on a first side of the elongated body segment 81, a small hole 85 on a second side end of the elongated body segment 81, and an R-type quick release pin 87. Other types of locking structures can be used such as a spring loaded plunger which engages a spring loaded ball bearing that selectively extends from a section of the elongated body segment 81 of the alternative exemplary locking bar 69. The retainer segment (e.g., thicker segment, locking structure, etc.) 83 prevents a first side of the elongated body segment 81 from sliding out of place with respect to collapsible rail 13 and support segments (e.g., 63, 65), and when the R-type quick release pin 87 is inserted into the small hole 85, it locks the second side of elongated body segment 81 so it does not slide out one of the collapsible rail 13 and support segment it was inserted and locked into.

Figure 8:
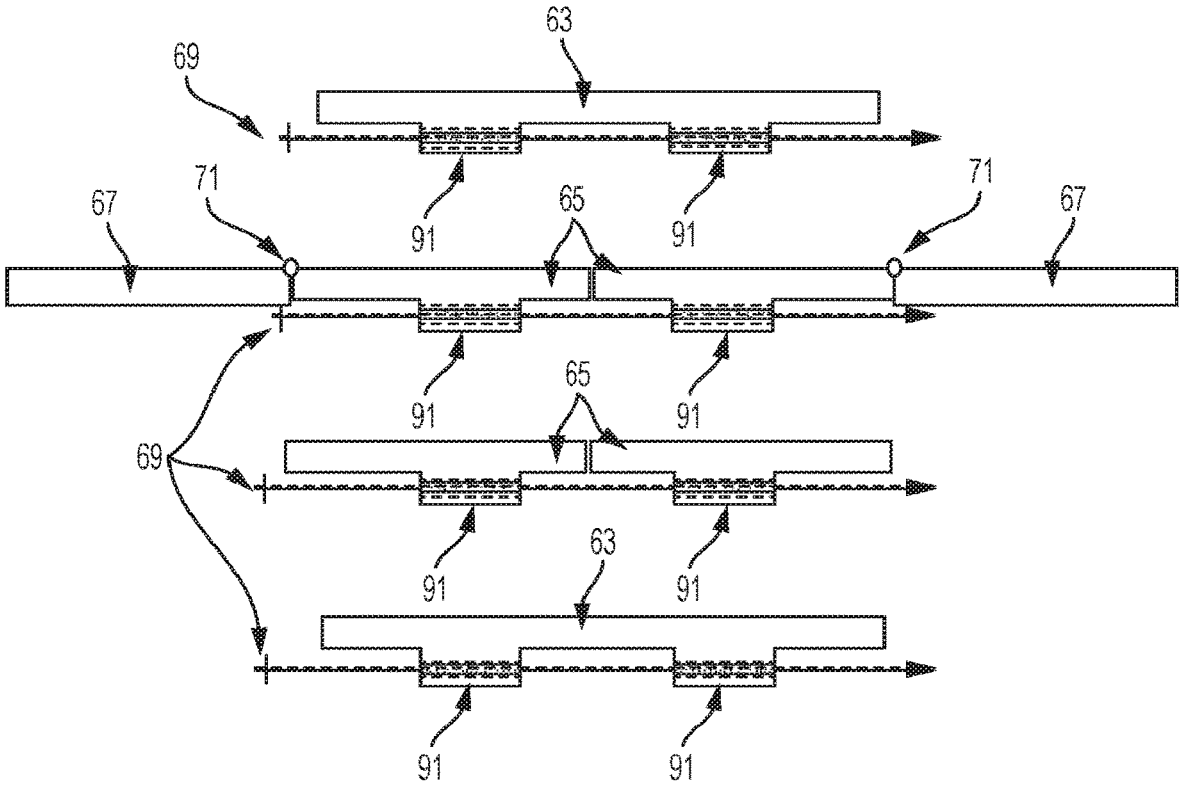
FIG. 8 shows an exemplary side view of each of the four rows of the segment configuration of the FIG. 6 structure.

FIG. 8 shows a simplified side view of each of the support segments shown in the FIG. 6 embodiment. Head or foot support segments 63 are shaped in such a way that they have two protruding segments on their lower side which slide between the collapsible rails 13. Trunk or torso support segments 65 are shaped in such a way that they have a single protruding segment on their lower side which slides between a pair of collapsible rails 13. Outer or shoulder support segments 67 can be flat on both the upper and lower surfaces, and can be coupled to the collapsible rails 13 by coupling hinges 71.

FIG. 8 also shows locking bars 69 attached to the support segments (63, 65, 67). Locking bars 69 can be attached to the support segments by inserting them through support segment holes 91 that pass through the protruding segments of the support segments (63, 65, 67).

Figure 9:
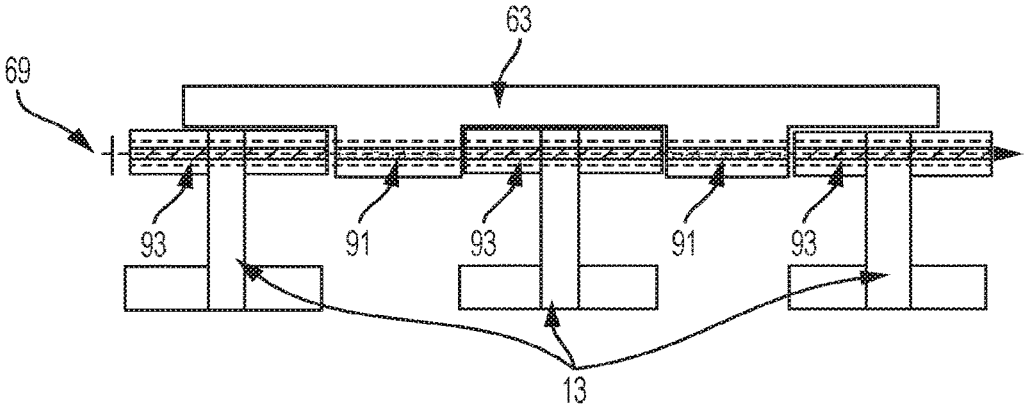
FIG. 9 shows a support segment from the FIG. 6 embodiment interacting with the collapsible rails.

FIG. 9 shows a side view of an exemplary head or foot support segment 63 attached to collapsible rails 13. In the FIG. 9 embodiment the collapsible rails 13 have horizontal rail holes 93 located in the upper layer of the collapsible rails 13. The locking bars 69 can be fed through support segment holes 91 and horizontal rail holes 93 to couple the collapsible rails 13 to the head or foot support segments 63. Collapsible rails 13 can have a plurality of horizontal rail holes 93 located along their structure to allow for adjustable placement of support segments (63, 65, 67).

Figure 10:
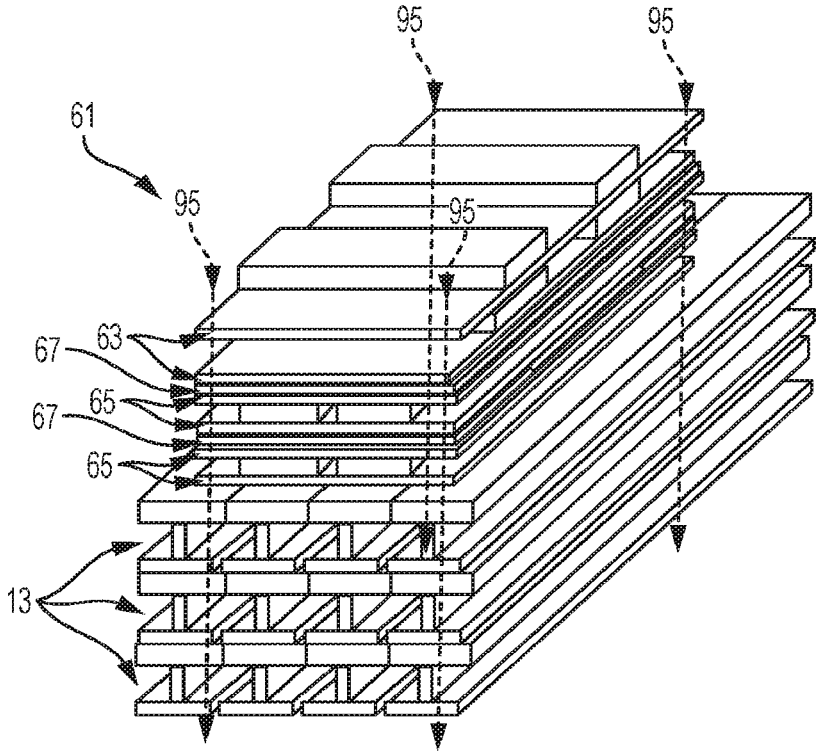
FIG. 10 shows a possible collapsed configuration of the support segments and rails shown in FIG. 6.

FIG. 10 shows a possible stacking configuration 51 of the three collapsible rails 13 and eight support segments (63, 65, 67) shown in FIG. 6. The three collapsible rails 13 are placed into their folded configuration and vertically stacked. Two trunk or torso support segments 65 are then stacked on top of the three collapsible rails 13 with their protrusions extending towards each other. The next stacked layer is an outer or shoulder support segment 67, followed by two more stacked trunk or torso support segments 65 with their protrusions extending towards each other, followed by another outer or shoulder support segment 67, finally followed by two head or foot segments 63 stacked with their protrusions facing up.

In some embodiments, the exemplary collapsed or folded configuration can have a plurality of vertical hole paths 95 that vertically extend through each of the stacked support segments (63,65, 67) and each of the stacked collapsible rails 13. Locking bars 69 can then be fed through each of the plurality of vertical hole paths 95 to secure the exemplary collapsed or folded configuration. Additional vertical hole paths 95 and locking bars 69 may be required if the support structure 61 requires additional rigidity. For additional stability while support structure 61 is in a collapsed or folded configuration, vertical hole paths 95 can be positioned so that they extend through the the first and last rail segments 41 on each of the plurality of collapsible rails 13, and through each corner of the support segments (63, 65, 67). In alternative embodiments, vertical hole paths 95 could be positioned so that they pass through each individual rail segment 41 to secure the collapsed or folded configuration 51.

Figure 11:
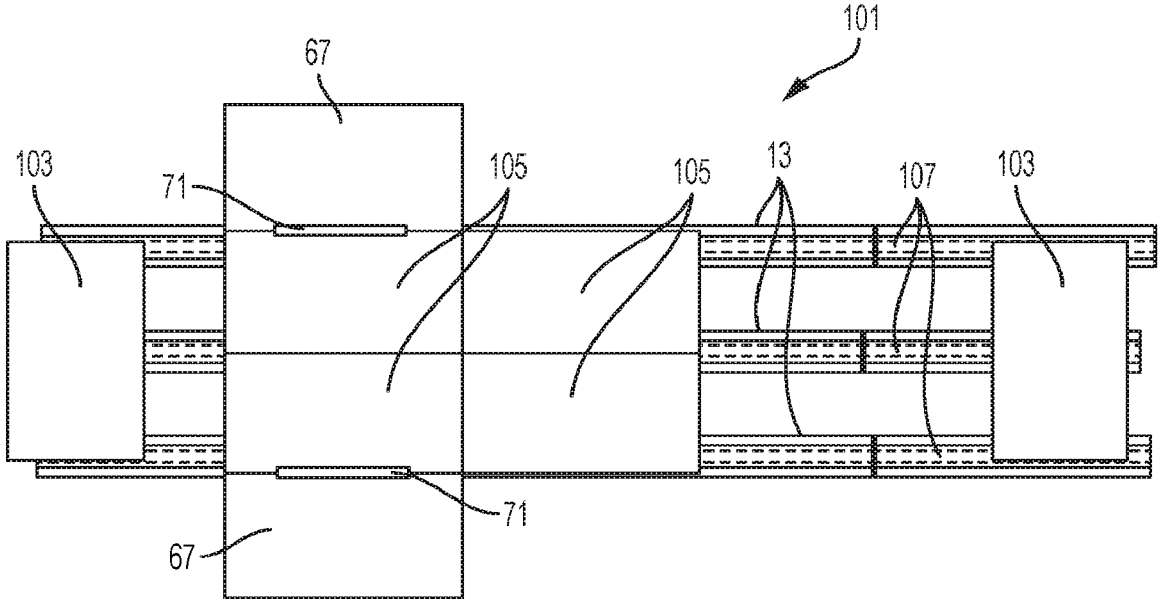
FIG. 11 shows a top-down view of a possible alternate embodiment of a portable and collapsible load bearing structure.

FIG. 11 shows a top-down view of another possible alternate embodiment of a portable and collapsible load bearing structure. The FIG. 11 support structure 101 is constructed by three collapsible rails 13, two head or foot slider support segments 103, four trunk or torso slider support segments 105, and two outer or shoulder support segments 67. In the FIG. 11 support structure 101 slider support segments 103 and 105 are coupled to collapsible rails 13 by a slide-mounting structure that couples the lower side of the slider support segments 103 and 105 to an upper side of the collapsible rails 13. In such an embodiment slider channels with roller bearings 111 (not shown in FIG. 11) could be coupled to the lower side of slider support segments 103 and 105 and load bearing sliders 107 could be coupled to the upper side of each collapsible rails 13. In some embodiments, coupling hinges 71 can be used to secure outer or shoulder support segments 67 to trunk or torso slider support segments 105.

Figure 12:
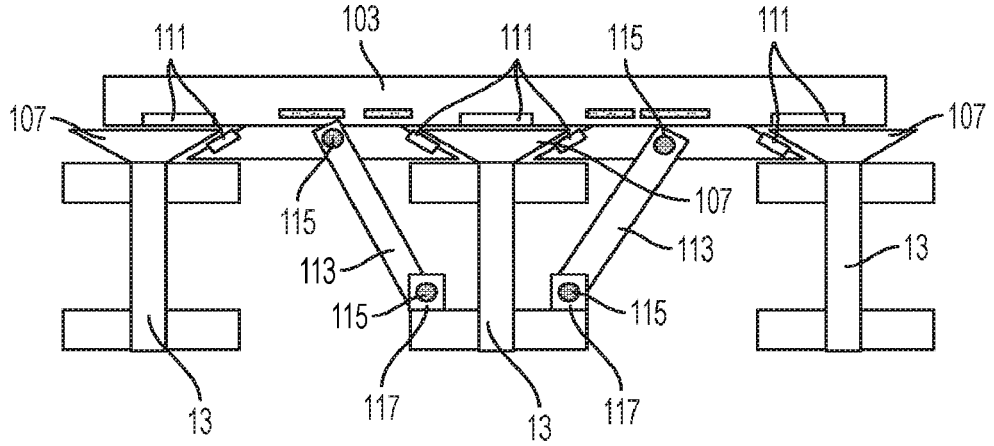
FIG. 12 shows an end side of a support segment from the FIG. 11 embodiment interacting with collapsible rails.

FIG. 12 shows how an exemplary head or foot slider support segment 103 might couple to a first, second, and third collapsible rails 13. The load bearing sliders 107 extend into slider channels with roller bearings 111 to allow the head or foot slider support segment 103 to slide into different positions on the collapsible rails 13. In some embodiments, to secure the head or foot slider support segment 103 in position on the collapsible rails 13, support beams 113 can be attached to the edge of the head or foot slider support segment 103, wherein one end of the support beams 113 can drop down and couple to collapsible rails 13. In some embodiments, a pivoting pin 115 can be used to secure one end of a support beam 113 to a slider support segment (103, 105), and another pivoting pin 115 can be used to secure the other end of the support beams 113 onto a rail locking mechanism 117 in such a way that both ends of the support beams 113 can rotate around an axis parallel to the side of the sliding support segment (103, 105).

Figure 13:
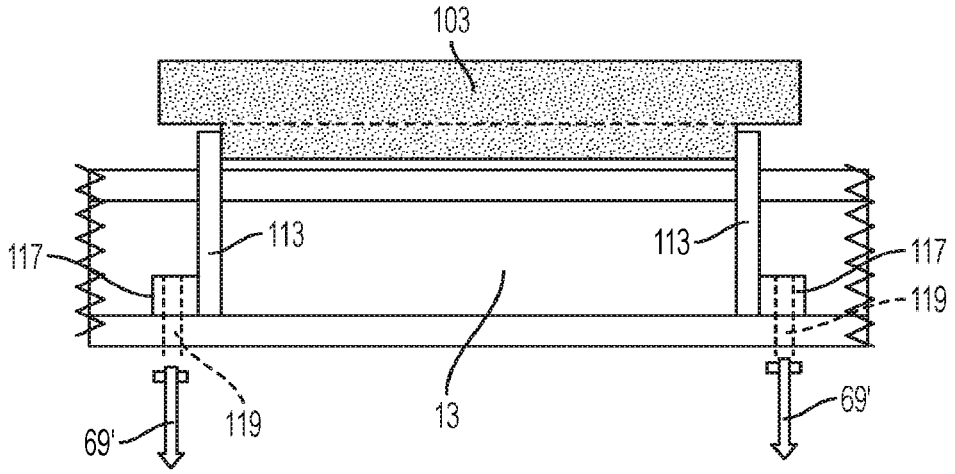
FIG. 13 shows an alternate side view of the FIG. 12 support segments locking into place onto a rail segment.

FIG. 13 shows a simplified alternate side view of the FIG. 12 head or foot slider support segment 103 coupled to the middle collapsible rail 13. The support beams 113 extend downward to allow the rail locking mechanism 117 to rest on top of the lower part of the collapsible rail 113, and can be secured in place by inserting smaller locking bars 69' through lower rail holes 119. Collapsible rails 13 can have a plurality of lower rail holes 119 located along their structure to allow for adjustable placement of the slider support segments (103, 105). In some embodiments, the slider support segments (103, 105) can have an upper and lower level, wherein support beams 113 are secure to the lower level, and the upper level extends outward further than the lower level in such a way that all parts of support beams 113 and rail locking mechanisms 117 remain below the upper level. In some embodiments, the smaller locking bars 69' can comprise of a single R-type quick release pin.

In some embodiments, slider support segments (103, 105) can be locked in place onto collapsible rails 13 by a series of brakes or clamps coupled onto the sides of the slider support segments (103, 105) that have a locked and unlocked configuration.

Figure 14:
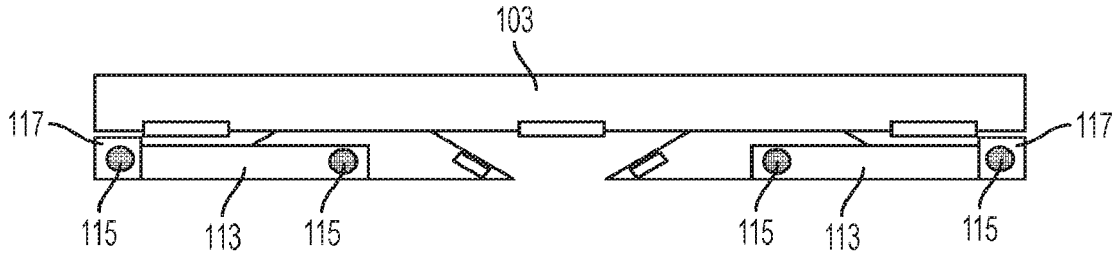
FIG. 14 shows the support segment from the FIG. 12 embodiment in a collapsed and stackable configuration.

FIG. 14 shows a head or foot slider support segment 103 in a stackable collapsed configuration. Support beams 113 can be configured to rotate upward around the pivoting pin 115 attached to the head or foot slider support segment 103 while rail locking mechanisms 117 rotate around the end of the support beams 113 in such a way that the bottoms of the support beams 113 and rail locking mechanisms 117 can line up with the bottom of the head or foot slider support segment 103. This configuration allows the head or foot slider support segment 103 to be vertically stacked with other slider support segments (103, 105) when the FIG. 11 support structure 101 is in a collapsed configuration.

Figure 15:
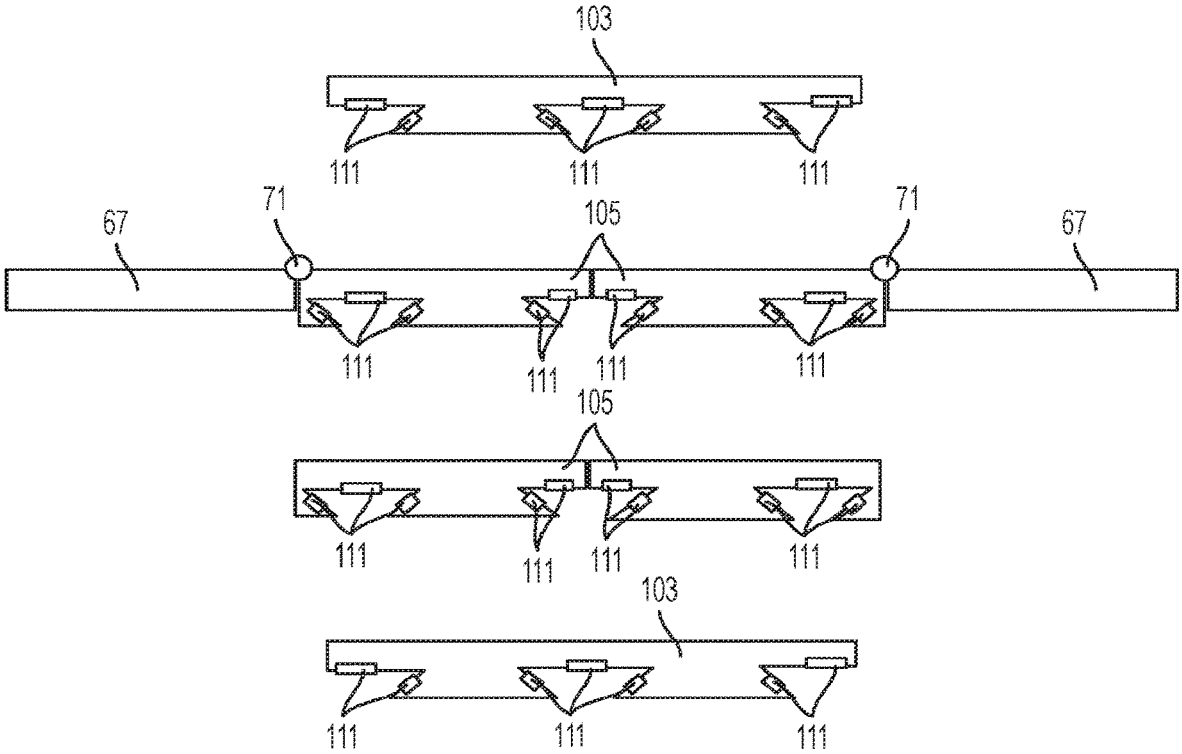
FIG. 15 shows a simplified exemplary side view of each of the four rows of the support segment configuration in FIG. 11.

FIG. 15 shows a simplified side view of each of the support segments (103, 105, 67) shown in the FIG. 11 embodiment without the support beams 113 or rail locking mechanisms 117. Head or foot slider support segments 103 are shaped in such a way that they have three channels with roller bearings 111 on their lower side which can couple to collapsible rails 13. Trunk slider support segments 105 are shaped in such a way that they have two channels with roller bearings 111 on their lower side which can couple to collapsible rails 13. Outer support segments 67 can be flat on both the upper and lower surfaces, and can be coupled to the collapsible rails 13 by coupling hinges 71.

Figure 16:
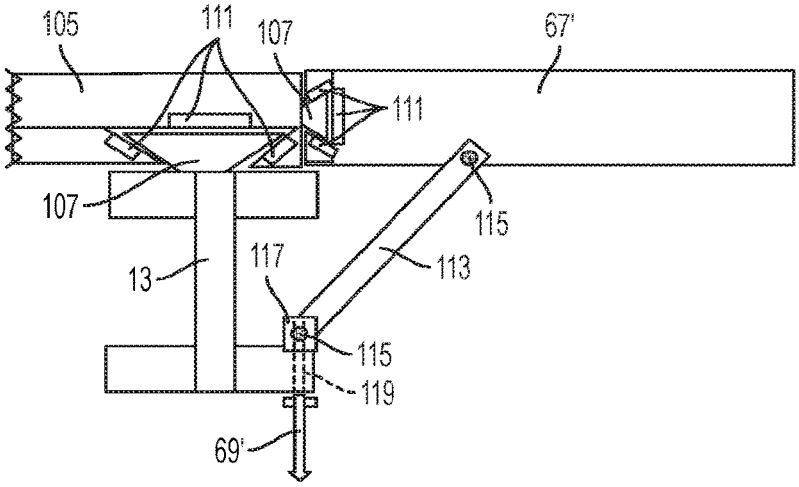
FIG. 16 shows an alternative structure that can be used to attach outer support segments.

FIG. 16 shows a structure that couples an alternate outer support segment 67' to a trunk slider support segment 103. In some embodiments load bearing sliders 107 can be coupled to the side of trunk slider support segments 103. The alternate outer support segments 67' can then have a channel with roller bearings 111 that can slide onto the load bearing sliders 107. The alternate outer support segments 67' can then be secured in place by support beams 113 and rail locking mechanisms 117 that can pivot around pivot pins 115 to drop down onto the collapsible rails 13. Locking bars 69' can then be fed through lower rail holes 119 to secure the rail locking mechanisms 117 to the collapsible rails 13.

Figure 17:
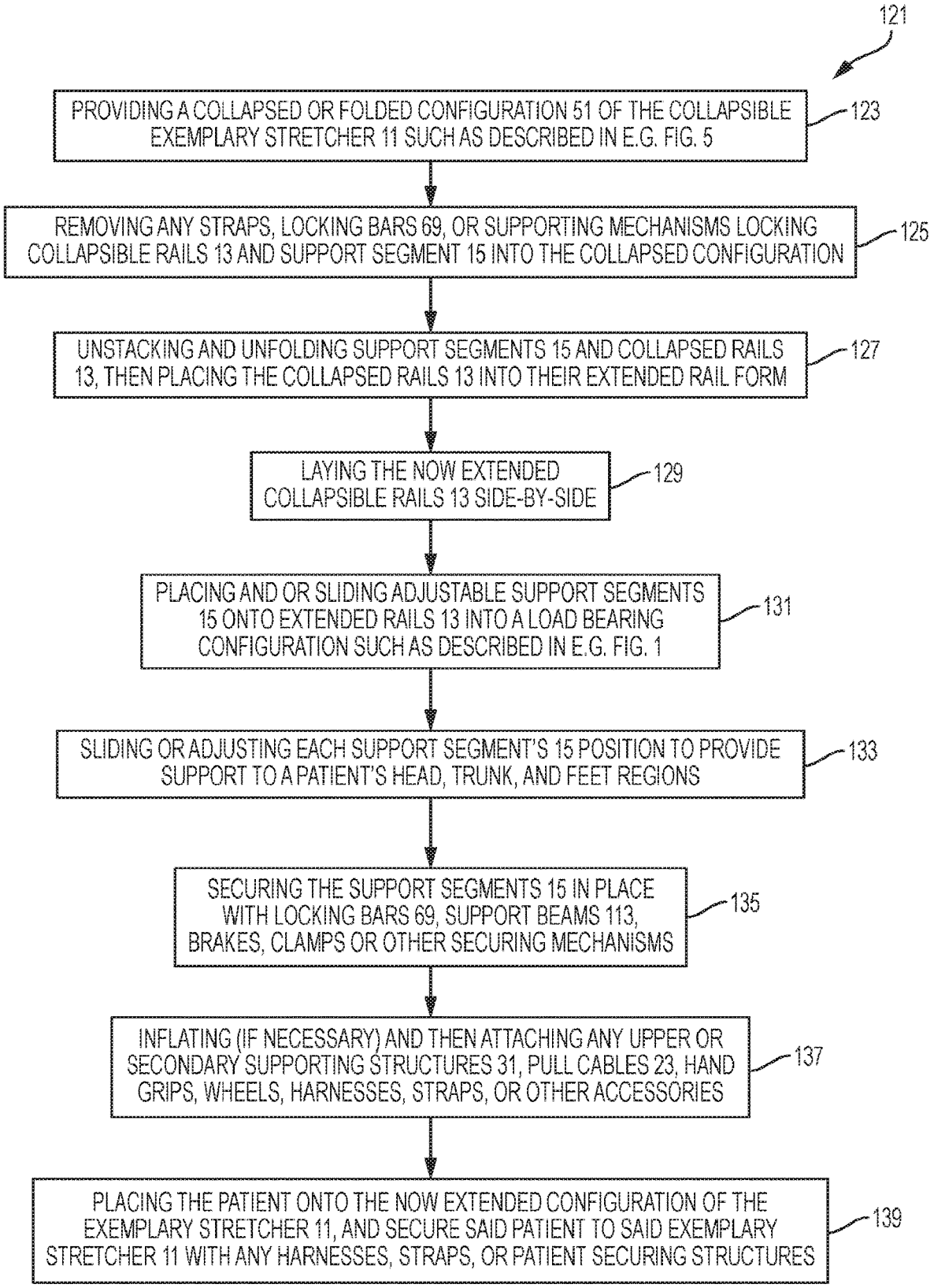
FIG. 17 is a flow chart depicting a method of assembling the exemplary portable and collapsible load bearing structure.

FIG. 17 shows a flow chart 121 depicting a method of assembling a collapsible exemplary structure 11 starting from a collapsed or folded configuration 51. At step 123, providing a collapsed or folded configuration 51 of a collapsible exemplary structure (e.g. stretcher 11) such as described in various embodiments herein. The collapsed or folded configuration 51 can include of a plurality of support segments 15 and a plurality of collapsible rails 13, as well as other accessories such as locking mechanisms, straps, harnesses, inflatable segments, wheels, locking bars 69, hand grips, securing mechanisms or other attachments. At step 125, detaching the locking mechanisms, straps, locking bars 69, or other securing mechanisms from the collapsed or folded configuration 51 to allow for a deconstruction of the collapsed or folded configuration 51. At step 127, disassembling the collapsed or folded configuration 51 by de-stacking the plurality of collapsible rails 13 and support segments 15. The collapsible rails 13 are to then each be straightened out into their extended rail forms such as described in FIG. 3. If collapsible rails 13 require latches or locking hinges to be held into their extended rail forms, the latches or locking hinges can then be locked. At step 129, arranging the collapsible rails 13 in a parallel disposition next to the other collapsible rails 13. Enough space between the collapsible rails 13 should be provided for the support segments 15 to abut and be secured to the collapsible rails 13. At step 131, placing, sliding, or rolling the support segments 15 onto the collapsible rails 13. The support segments 15 can be disposed or adjusted onto the collapsible rails 13 generally in a configuration correlated to a human head, feet, trunk/torso, and shoulders positions (e.g., via head support pad 17, foot support pad 19, and trunk support pad 21 (torso and shoulders), such as described in FIG. 1). At step 133, adjusting the support segments 15 up and down the collapsible rails 13 to adjust and approximately match or correlate respective support segments with an actual patient's head, feet, and trunk (torso and shoulder) regions. At step 135, securing the support segments 15 into position by one of a variety of locking structures in a particular embodiment (e.g., inserting locking bars 69 (see, FIG. 9), support beams 113 (see FIG. 12), brakes, clamps, latches, quick release pins, or other securing mechanisms). At step 137, inserting one or more upper or secondary support structures 31, pull cables 23, hand grips, wheels, harnesses, straps, or other accessories to provide additional support, ease-of-transportation, rigidity, comfort, or safety. At step 139, disposing the patient onto the collapsible exemplary stretcher 11 in such a way that the patient's head is received and supported by head support pad 17, the patient's feet is received and supported by the foot support pad 19, and the patient's trunk (torso and shoulders) region are received and supported by the trunk support pad 21 (torso and shoulder). Optionally, a follow on step can include securing the patient onto the collapsible exemplary stretcher 11 by various harness, straps, or other patient securing structures.

Figure 18:
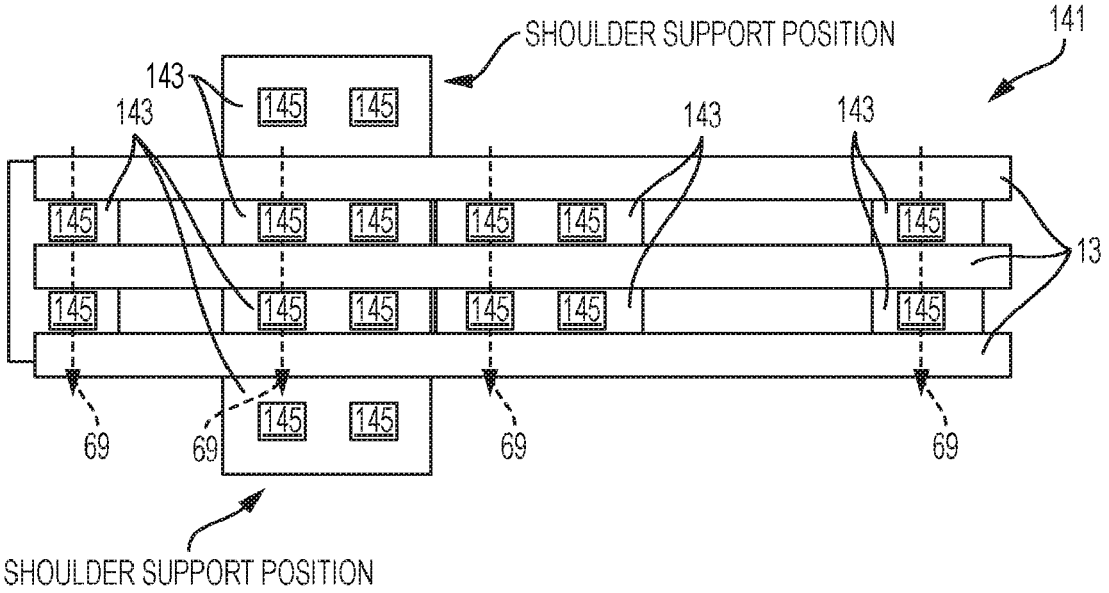
FIG. 18 shows a bottom view of an alternate embodiment of the FIG. 1 portable and collapsible load bearing structure.

FIG. 18 shows a bottom view of an alternate embodiment 141 of the FIG. 1 portable and collapsible load bearing structure. Alternate embodiment 141 is constructed by a plurality of universal support segments 143 and collapsible rails 13. Two guides (e.g. a first and second guide) 145 extend from or are coupled to a lower side of the universal support segments 143 in a first orientation. Each of the exemplary guides 145 are dimensioned to fit between any two collapsible rails 13 in a plurality of orientations of the universal support segments 143 in at least two orientations with respect to the collapsible rails 13 (e.g., longitudinally or laterally). The universal support segments 143 are coupled to the collapsible rails 13 by locking bars 69 that extend through guides 145 (see FIG. 9, FIGS. 19*a*, and 19*b*). Universal support segments 143 positioned in a shoulder support position (extending away from both sides of the rails laterally) can be coupled to an adjacent universal support segment 143 using 180 degree hinges (e.g., see FIG. 8, 71) that enable the shoulder support position universal support segments 143 to fold onto adjacent universal support segments 143. This embodiment can also include a variant where at least some of locking bars 69 (e.g., two locking bars 69) pass through all guides 145 in rows extending across and between all universal support segments in the shoulder support positions (e.g. shoulder position segment, upper torso position segment, upper torso position segment, and shoulder position segment) running laterally with a longer locking bar 69 than other locking bars which provides additional stability for shoulder support position universal support segments 143.

Figure 19A:
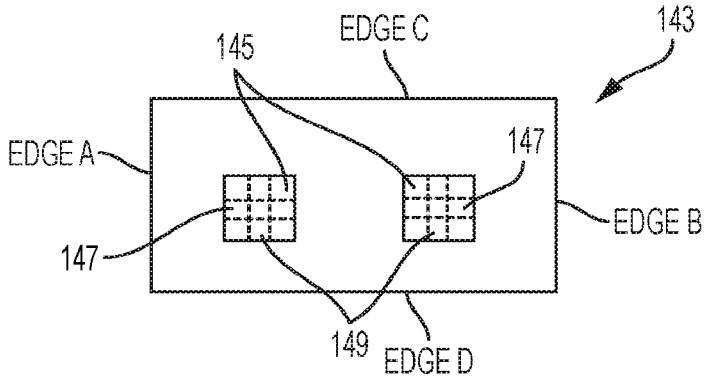
FIG. 19*a* shows a partial cut-away bottom view of the exemplary support segment shown in FIG. 18.
Figure 19B:
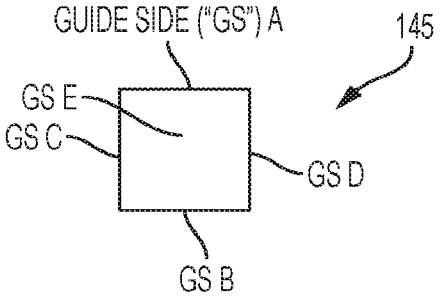
FIG. 19*b* shows an enlarged bottom view of an exemplary FIG. 18 guide.

FIG. 19*a* shows a partial cut-away bottom view of a single exemplary universal support segment 143 as shown in FIG. 18. In some embodiments, the universal support segment 143 is formed into a rectangular shape, having a first A, second B, third C, and fourth D edge section where the first A and second B edge sections are shorter than the third C and fourth D edge sections. The exemplary guides 145 are formed extending away from the lower side of the universal support segment 143. Referring to FIG. 19*b*, the exemplary guides 145 are formed having a first guide side ("GS") GS A, a second GS B opposing the first GS A, a third GS C, a fourth GS D opposing the third GS C, and a fifth GS E wherein the first GS A, second GS B, third GS C, and fourth GS D guide sides define edges of the fifth GS E by forming a square shape extending orthogonally from the lower side of the universal support segment 143. In some embodiments the guides 145 can be formed as a part of the universal support segment 143 or attached as a separate component. The exemplary guides 145 are further disposed or formed in such a way that a first distance running from the third edge section C to a first GS A is greater than a second distance running from the fourth edge section D to a second GS B face wherein the first GS A and second GS B guide sides are orthogonal to the lower side. In some embodiments, the first distance can be defined by a lateral width of collapsible rail's 13 flange section which is orthogonal to the collapsible rail's 13 web section. Each of the exemplary guides 145 are disposed or positioned in such a way that a center section of the guide 145 edge faces are offset from a first axis running from a center point of the first A and second B edges. In this embodiment, each of the guides 145 is disposed or formed on the universal support segment 143 such that the guides 145 are equidistantly spaced apart by a third distance from each other along a second axis running through center sections of opposing sides of the guide 145 that is parallel to the first axis. The third distance can be defined by a lateral width of collapsible rail's 13 flange section which is orthogonal to the collapsible rail's 13 web section. Each of the exemplary guides 145 is formed with a first 147 and second aperture 149. The first aperture 147 runs through a center section of the first GS A to the second GS B. The second aperture 147 runs through a center section of the third GS C to the fourth GS D.

Figure 20:
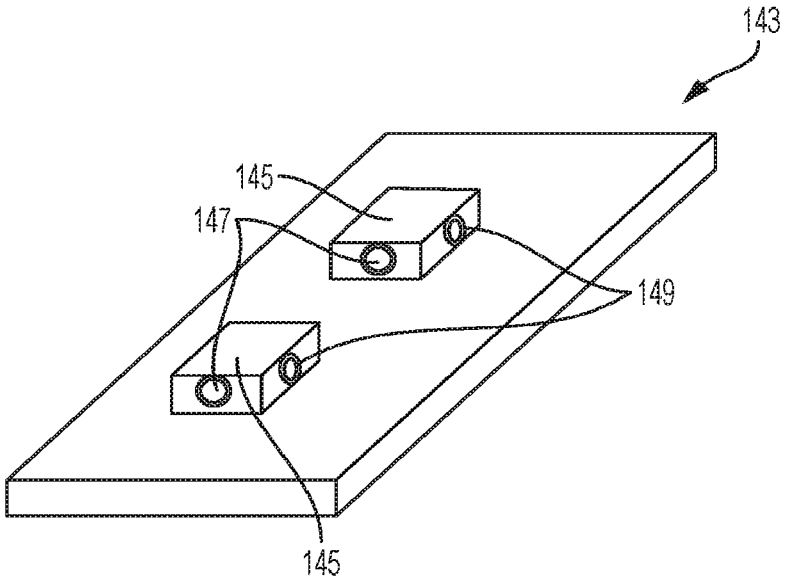
FIG. 20 shows a perspective view of the exemplary support segment shown FIG. 18.

FIG. 20 shows a perspective view of the exemplary universal support segment 143 shown in FIGS. 18-19 to include the above referenced guides 145. FIG. 20 shows the first 147 and second 149 apertures that pass through their respective guide side faces (e.g., GS A to GS B, or GS C to GS D).

Although the invention has been described in detail with reference to certain preferred embodiments, variations and modifications exist within the spirit and scope of the invention as described and defined in the following claims.

The invention claimed is:

1. A method of assembling a portable and collapsible load bearing structure to an extended load bearing configuration from a collapsed configuration, comprising:

providing a portable and collapsible load bearing structure in a collapsed configuration including a plurality of securing elements that secure said portable and collapsible load bearing structure in said collapsed configuration;

unstacking and separating said portable and collapsible load bearing structure into a first, second, and third plurality of folded rail segments and a plurality of support segments, wherein the first, second, and third pluralities of folded rail segments each comprise a plurality of rail segment couplings comprising a plurality of hinge structures and a plurality of locking elements and configured to be oriented in a selectively latched or locked extended rail configuration or a collapsed configuration;

extending and securing said first, second, and third plurality of folded rail segments to create a first, second and third collapsible rails;

placing each of said first, second and third collapsible rails into such a location that they are parallel with each other;

placing or sliding each of said plurality of support segments onto said first, second and third collapsible rails in such a position that said plurality of support segments can support a human-shaped load;

adjusting the positions to accommodate a specific human-shaped load;

securing said plurality of support segments in place; and placing said human-shaped load onto said portable and collapsible load bearing structure.

2. A method as in claim 1, wherein a larger support segment, a harness, a pull cable, a plurality of hand grips, or a plurality of at least one wheel is attached to said portable and collapsible load bearing structure.

* * * * *